United States Patent [19]

Noro et al.

[11] 4,389,360

[45] Jun. 21, 1983

[54] METHOD OF FORMING A PROTECTIVE COATING ON A LONG LANCE TO BE IMMERSED IN MOLTEN METAL

[75] Inventors: Katsuhiko Noro; Yūsei Nagaki; Shinpei Sasaki, all of Tokai; Sakae Kumagai, Chita, all of Japan

[73] Assignees: Nippon Steel Corporation, Tokyo; Yoshikawa Kogyo Co., Ltd., Fukuoka, both of Japan

[21] Appl. No.: 215,038

[22] Filed: Dec. 10, 1980

[30] Foreign Application Priority Data

Dec. 15, 1979 [JP] Japan ..... 54-162992

[51] Int. Cl.[3] ..... B28B 1/08

[52] U.S. Cl. ..... 264/71; 264/275; 264/279

[58] Field of Search ..... 264/71, 275, 279

[56] References Cited

U.S. PATENT DOCUMENTS 3,848,034 11/1974 Schaeter ..... 264/71
4,039,642 8/1977 Steiro ..... 264/71

FOREIGN PATENT DOCUMENTS 54-3264 1/1979 Japan ..... 264/72
54-29286 3/1979 Japan .

*Primary Examiner*—James H. Derrington
*Attorney, Agent, or Firm*—Wenderoth, Lind & Ponack

[57] ABSTRACT

A method of forming a protective coating on a long immersible lance is disclosed. A mold having an inlet port in a peripheral portion thereof is laid on its side so that the inlet port faces upwardly. A long lance is set in the mold with a clearance left between the mold and the lance that corresponds to the required thickness of coating. Then a coating material is cast into the clearance through the inlet port to thereby form a coating on the lance, followed by drying of the coating.

6 Claims, 9 Drawing Figures

METHOD OF FORMING A PROTECTIVE COATING ON A LONG LANCE TO BE IMMERSED IN MOLTEN METAL

BACKGROUND OF THE INVENTION

1. Field of the Invention

This invention relates to a method of forming a protective coating of castable refractory material on a lance for desulfurizing molten iron, a lance for controlling the temperature of molten steel and other long lances through which a gas or powder is injected into molten metal in which they are immersed. More particularly, the invention relates to a method of forming a protecting coating on a long lance of the above described type, preferably having a length greater than 1 m (such lance is hereunder referred to as a long immersible lance).

2. Description of the Prior Art

A lance having a protective refractory coating is used when molten iron is freed of sulfur or other impurities in a container such as a ladle or torpedo car. But, as accompanying FIG. 1 shows, a protected lance 15 in molten metal 16 is subject to a great degree of erosion at the lower middle portion, in particular, the portion where the lance contacts slag 17 floating on the surface of the metal. A lance which is eroded in the lower middle portion is disconnected for replacement by a new gas injection lance. Therefore, the life of a refractory-coated lance generally depends on the life of the lower middle portion of the protective refractory coating.

FIG. 2(*a*) shows how an immersible lance conventionally is provided with a protective coating. Within a mold 1 that conforms to the vertical configuration (inverted with respect to the lance position in use mode), a lance 4 is set to provide a clearance that is equal to the coating thickness, and the gap is filled with a coating material 7 that is supplied from a mixer 5 through an opening 2 in the top of the mold 1. FIG. 2(*b*) is a transversal cross section FIG. 2(*a*) taken along the line A—A, and it shows one embodiment of the lance 4 set in the mold 1. For uniform packing of the coating material 7 around the lance 4, a vibrator 3 is used. The vertically installed mold is commonly employed because the coating material can be supplied overhead and so, a simple construction of the mold will do.

However, it has been found that if the conventional method is used to form a protective coating on a long lance, it is impossible to form a uniformly dense coating for the length of the lance because for one thing, the upper portion of the lance in the mold is unavoidably covered with a less dense coating than the lower. Also a settable substance such as the aggregate or fibrous material, when attempting to add fibrous material as a reinforcing material, in the coating material settles in the lower portion of the mold. As a result, the lower middle portion of the coating on the lance in the use mode that contacts slag does not have an adequate amount of a reinforcing material (e.g. aggregate or fibrous material) and coupled with the low density described above, that portion does not have as high strength or resistance to slag erosion as does the upper portion of the coating. Consequently, the good properties of the coating material are not reflected in the actual durability of the resultant coating. As shown in FIG. 2(*a*), the lance 4 is set in the mold 1 in a position inverted to that of the lance in the use mode, so the upper portion of the lance during the coating application corresponds to the lower portion of the lance in the use mode. This means that the portion of the lance which is less strong and erosion-resistant is subjected to severer, hence more unfavorable conditions during use.

Therefore, this invention provides an improved method of forming a protective coating on a long immersible lance.

Several methods have been devised and reported to prevent damage of a castable refractory coating on a long lance of the type contemplated by this invention. One example is described in Japanese Utility Model Publication No. 29286/79 (Japanese Utility Model Application No. 15097/76 "Lance for injecting gas for treatment of molten metal"). It discloses a lance which is surrounded at suitable intervals by a plurality of short steel tubes which are covered with a castable refractory material to prevent the formation of cracks in the castable refractory layer due to the difference in thermal expansion coefficient between the lance and the surrounding castable refractory coating. But the reference has no idea of the technique to improve the erosion resistance of the coating layer, so unlike this invention, it makes no mention at all of the position in which the mold is filled with a castable refractory, although FIG. 1 and the related description in the specification suggest that a vertical position is intended.

The Japanese Industrial Standards (JIS) A5302 describe a method of producing a reinforced concrete pipe. According to this method, concrete is cast into a mold which is erected upright and the concrete is set by vibratory compacting. Therefore, the method differs in construction from this invention which achieves formation of a coating having uniform distribution of grain size and ingredients throughout the length of the coating by pouring a castable refractory into a mold lying on its side through an inlet port provided in the top of the mold, and the refractory is set without erecting the mold upright.

SUMMARY OF THE INVENTION

The primary object of this invention is to provide a method of forming a protective coating on a long lance which is immersed in use. The coating formed on the lower middle portion of the lance that contacts with slag in the use mode has improved strength.

Another object of this invention is to provide a method of forming a coating having greater longitudinal uniformity than a coating produced by the conventional method which sets a lance in an upright mold. Hence, the method of this invention is capable of providing a long immersible lance having greater strength, high resistance to slag erosion and longer service life than the immersible lance given a protective coating by the conventional method.

A further object of this invention is to provide a method of forming a protective coating in a shorter period of time than the conventional method which sets a lance in an upright mold.

Still another object of this invention is to provide a method of forming a protective coating that is safer than the conventional method that uses an upright mold.

A further object of this invention is to provide a method of forming a protective coating that casts a coating material through a larger opening than the conventional method using an upright mold, permits easier casting of the coating material into a mold, and which requires less vibrational force to set the cast material.

Another object of this invention is to provide a method of forming a protective coating which uses a coating material that contains less water than in the conventional method using an upright mold, which hence has increased strength and provides a coating layer that is more crack-resistant and which requires less fuel to dry.

To achieve these objects, the following methods are provided:

1. A method of forming a protective coating on a long immersible lance wherein a mold having an inlet port on a peripheral portion thereof is laid on its side so that the inlet port faces upwardly. A long lance is set in the mold with a clearance left between the mold and the lance that corresponds to the required coating thickness. Then a coating material is cast into the clearance through the inlet port to thereby form a coating on the lance, followed by drying of the coating.

2. A method of forming a protective coating according to Paragraph 1 wherein a vibrator is operated during or after casting of the coating material to ensure that the gap between the lance and mold is filled with a uniform and dense layer of the coating material.

3. A method of forming a protective coating according to Paragraph 1 wherein the lance is rolled and vibrated in the mold to provide a uniform and dense layer of the coating material.

4. A method of forming a protective coating according to Paragraph 1 wherein the coating material to be cast consists of a castable refractory and a reinforcing material.

BRIEF DESCRIPTION OF THE DRAWINGS

FIG. 2(*b*) is a transversal cross section of FIG. 2(*a*) taken along line A—A therein;

DETAILED DESCRIPTION OF THE INVENTION

The method of forming a protective coating according to the method of this invention will now be described. FIGS. 3 to 8 represent two embodiments of an apparatus used in the method of this invention. A mold 1 fabricated to the length and size of the coating to be formed on a lance 4 is laid on its side so that its axis is generally horizontal. For the purposes of this invention, the mold 1 need not be laid on its side so that its axis is horizontal in the strict sense of the term and it may incline within a range that does not depart from the scope and spirit of the invention, but is should be understood that preferably, the axis of the mold laid on its side is as close as possible to the horizontal. The limit of the inclination to the horizontal is 15° or less. One or more ports 2 through which the coating material is supplied are made in the mold 1, and the number and configuration of the inlet ports may be properly determined depending on the particular situation.

Figure 7:
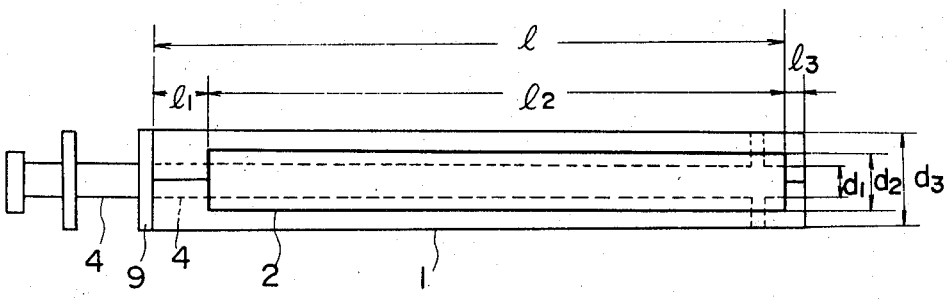
FIG. 7 is a schematic plan view of the apparatus used in the method of this invention which shows the relation between the size of the inlet port and that of the lance in the case where the mold has one inlet port.
Figure 8:
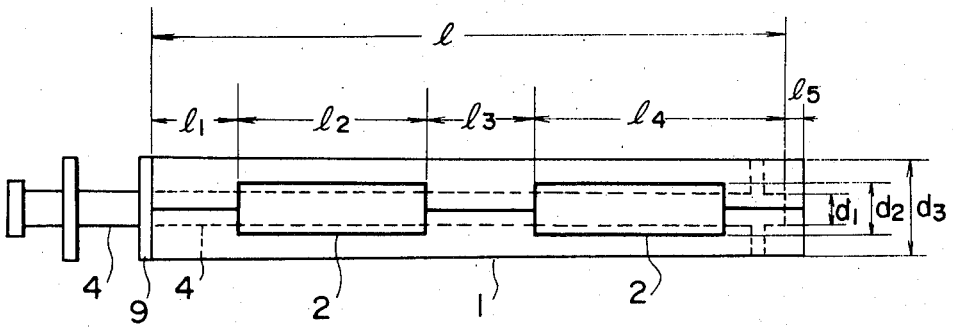
FIG. 8 is a schematic plan view of the apparatus shown in FIG. 3 which shows the relation between the size of the inlet port and that of the lance in the case where the mold has two inlet ports.

FIG. 7 shows a mold 1 which is provided with one inlet port, and FIG. 8 shows a mold 1 which is provided with two inlet ports. In these figures, l is the distance from a flange 9 of the lance 4 to its tip; $l_1$, $l_2$, $l_3$, $l_4$ and $l_5$ are the distances between different points of the lance 4 and the inlet port 2; $d_1$ is the outer diameter of the lance 4; $d_2$ is the width of the inlet port 2; and $d_3$ is the inner diameter of the mold 1.

As shown in FIGS. 7 and 8, the inlet 2 having a width $d_2$ slightly larger than the diameter $d_1$ of the lance 4 permits easy pouring of a castable refractory into the mold. The width $d_2$ of the inlet port 2 is preferably in the range of $1.2\ d_1 \leqq d_2 \leqq 2.4\ d_1$. The reason for defining the $d_2$ in that range is to fill the gap between the mold and lance with a uniform dense layer of castable refractory without being interfered with by the lance 4. As FIGS. 7 and 8 show, the inlet port 2 is made in the peripheral section of the mold 1 at a portion where the lance 4 is to contact slag. The mold 1 is so placed that the inlet port 2 faces upwardly.

In this invention, the position of the inlet port and the length of its opening should be determined properly by the fluidity of the castable refractory to be poured and the time allowed for pouring of the castable refractory. For the purposes of this invention, the length of the opening of the inlet port is very important and for pouring under atmospheric pressure, the position of the inlet port and the length of the opening should be so selected that the density of the layer of coating material with which the gap between the mold and lance is packed is adequate throughout the length of the resultant coating. For example, in FIG. 7, the ratio of the length of the opening of the inlet port to the length of the mold is as follows:

$$\frac{\text{the length of the opening (3800–3900mm)}}{\text{the length of the mold (4100mm)}} \times 100 = 93\text{–}95\%$$

The wider the opening of the inlet port, the faster the castable refractory can be poured into the mold, but too wide an opening allows excessive castable refractory to bulge outwardly from the opening, and as a result, much time is required to trim the refractory coating after demolding, and in addition, the trimmed castable refractory is simply wasted. Therefore, the width of the opening of the inlet port is preferably held in minimum on the condition that the pouring operation not be interfered with and that a dense layer of refractory coating be provided.

A vibrator 3 may be installed on the outside surface of the mold to fill the gap between the mold and lance with a uniform and dense layer of coating material, and it should be understood that this invention is by no means limited to this particular embodiment. Within the mold 1 installed as described above, the part of the lance 4 which is to be covered by a castable refractory is set to leave a gap between the mold and the lance that is equal to the thickness of the coating to be formed, and seal plates 8 are attached to both ends of the part of the lance 4 which is to be covered by a castable refractory. A coating material comprising a castable refractory and a reinforcing material such as an aggregate or a fibrous heat-resistant metal (i.e. steel fiber) is kneaded in a mixer 5 placed near the mold 1 and is cast into the mold 1 through the inlet port 2. During or after casting of the coating material, the vibrator 3 is operated to fill the gap between the mold and lance with a uniform and dense layer of the coating material. Studs 6 may be embedded around the lance 4 to secure strong engagement between the lance 4 and the coating material. The lance 4 may even be wrapped with a metallic material such as metal gauze. The lance 4 may be reinforced with reinforcing bars. After the gap between the mold and the lance is filled with a dense layer of the coating material, the layer is set and then the mold 1 is removed for drying the coating layer by a suitable means.

In the method of this invention for forming a protective coating on a lance, the coating material cast in the gap between the mold and lance travels only a very short vertical distance, so that settlement or segregation of ingredients of the casting material can hardly present a practical problem, and as a result, a coating layer of high uniformity is provided. According to this invention, a coating layer of better uniformity can be produced by rotating the mold 1 as well as the lance 4 while optionally casting the coating material through the ends of the mold after closing the inlet ports 2.

Molten iron was desulfurized using a lance covered with a refractory coating formed according to the method of this invention, and the life of the lance was about three times as long as that of the lance provided with a refractory coating by the conventional method that used an upright mold.

This invention now will be described in greater detail by reference to the following example and comparative examples wich are given here for illustrative purposes only and are by no means intended to limit the scope of this invention.

EXAMPLE 1

Six hundred kilograms of a castable refractory comprising 45 wt% of $Al_2O_3$, 45 wt% of $SiO_2$ and 10 wt% of a clayed binder, 300 kg of coarsely divided castable refractory of the same composition (average particle size: 3.0 mm), 30 kg of stainless steel fibers (average length: 30 mm), and 60 kg of water were mixed in a mixer to prepare a coating material. Before setting a lance in a mold of the configuration shown in FIGS. 3, 4 and 8 which was laid on its side, the mold was opened for cleaning that lasted for 30 minutes. Then, the lance was set in the mold in a period of 30 minutes, and the mold was closed during a period of 20 minutes. The respective dimensions of the arrangement as shown in FIG. 8 were as follows: $l=4000$ mm, $l_1=100$ mm, $l_2=1900$ mm, $l_3=100$ mm $l_4=1900$ mm, $l_5=100$ mm, $d_1=65$ mm, $d_2=90$ mm and $d_3=300$ mm. The coating material was cast into the mold during a period of 235 minutes. The mold was vibrated with a vibrator for 4 minutes. The cast coating material was cured by standing, the mold was opened (20 minutes), and the lance was removed from the mold and left to stand for 40 minutes. The lance (indicated at 15 in FIG. 5) was dried in an oven. The coating material that overflowed the inlet ports shown in FIGS. 5 and 6 set to form an excess portion (indicated at 10 in those figures). That portion was trimmed off (5 min). It is to be noted that the trimming was not essential and that a lance having the excess portion 10 serves a practical purpose. The lance thus obtained was used to desulfurize molten iron in a torpedo car. The temperature of the melt was approximately 1400° C., the sulfur content was reduced from 0.04% to 0.005%, and the desulfurization time was ca. 20 minutes per charge.

The portion of the lance which contacted slag in the molten iron and which was eroded most (i.e. 1000 to 2000 mm from the tip of the lance) was checked for the severity of cracking and wear by erosion. The results are shown in Tables 1 and 2.

COMPARATIVE EXAMPLE 1

Figure 1:
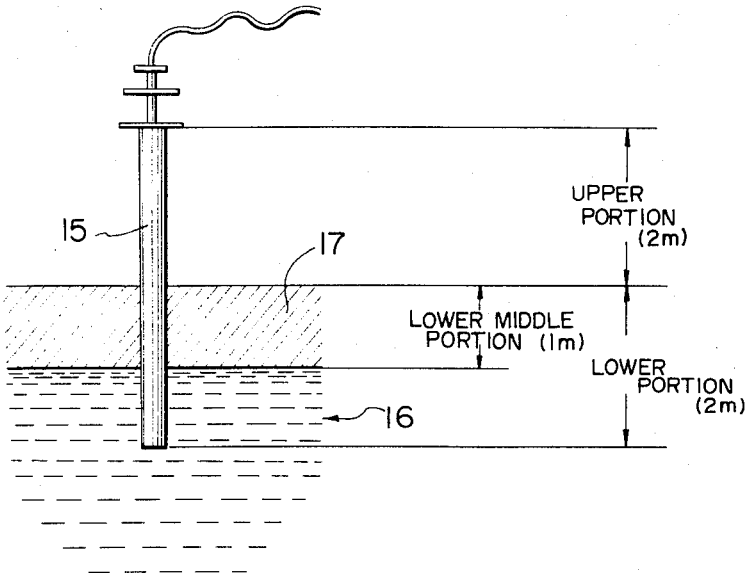
FIG. 1 illustrates how the lance is used in one mode of practical application of the present invention.
Figure 2A:
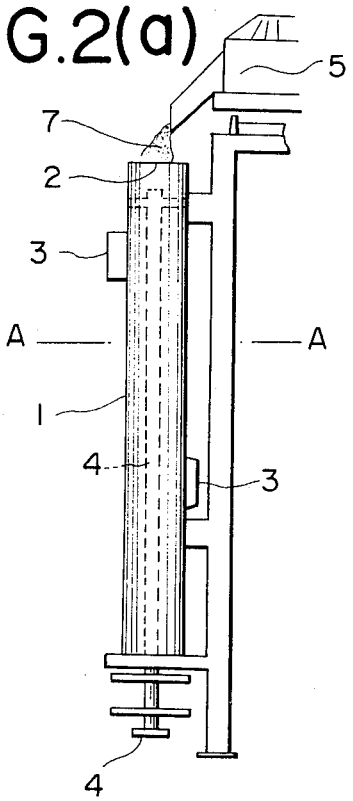
FIG. 2(*a*) is a schematic side view of one embodiment of an apparatus used in the conventional method of forming a protective coating on a lance set in an upright mold.
Figure 2B:
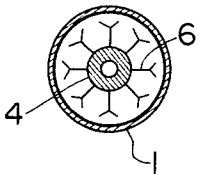
Figure 3:
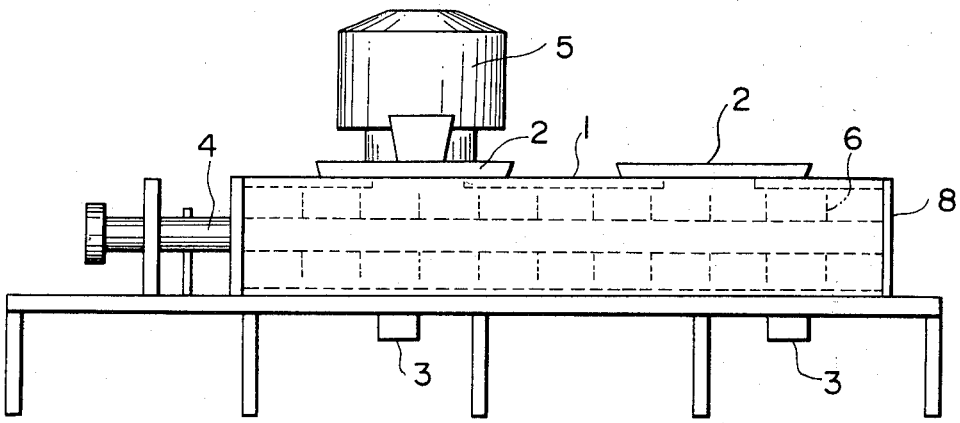
FIG. 3 is a schematic side view of one embodiment of an apparatus used in the method of this invention.
Figure 4:
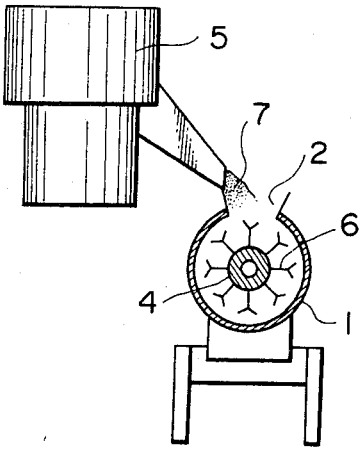
FIG. 4 is a schematic representation of how the mold is filled with the coating material according to this invention.
Figure 5:
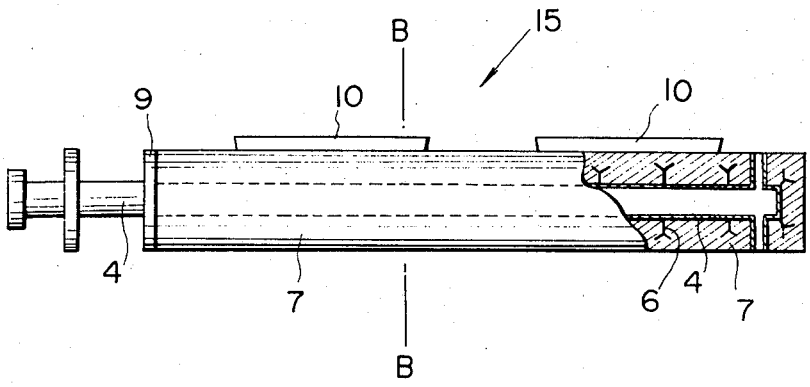
FIG. 5 is a partial side cross section of the lance covered with a protective coating according to the method of this invention using the apparatus shown in FIG. 3.
Figure 6:
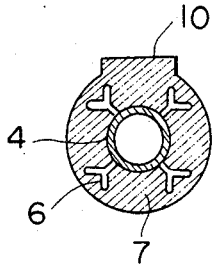
FIG. 6 is a schematic transversal cross section of FIG. 5 taken along line B—B therein.

A coating material was prepared in a mixer from the same formulation as used in Example 1. Before setting a lance in an upright mold of the configuration shown in FIGS. 2(*a*) and 2(*b*), the mold was opened for cleaning that lasted for 60 minutes. A scaffold was installed for setting the lance (30 minutes) in the mold and the scaffold was then removed (installation and removal of the scaffold took 40 minutes). The mold was then closed during a period of 40 minutes. The coating material was cast into the mold during a period of 235 minutes. The mold was vibrated with a vibrator for 8 minutes. The cast coating material was cured by standing. The mold was opened (40 min), a scaffold was installed for removing the lance, and the scaffold was removed. The installation and removal of the scaffold took 15 minutes. The lance was left to stand for 90 minutes. The lance was dried in an oven. The dried lance was used to desulfurize molten iron in a torpedo car under the same conditions as used in Example 1. The portion of the lance which contacted slag in the molten iron and which was eroded most (i.e. 1000 to 2000 mm from the tip of the lance) was checked for the severity of cracking and wear by erosion. The results are shown in Tables 1 and 2.

TABLE 1

| | Comp. Ex. 1 | Ex. 1 |
|---|---|---|
| Cracking development | once for 3 charges | once for 5 charges |
| Crack size | 5–10 mm wide | 1–3 mm wide |

As the table shows, cracks developed at studs less frequently in the lance given a protective coating by the method of this invention than in the lance coated by the conventional method. In Comparative Example 1, the lance developed cracks as wide as 5 mm or more and this was a problem, but in Example 1, good results were obtained in that the size of the cracks developed was not more than 3 mm.

TABLE 2

| | Comp. Ex. 1 | Ex. 1 |
|---|---|---|
| max. wear at the immersed part | 2.06 mm/ch. | 0.62 mm/ch. |

As the table shows, the lance prepared in Comparative Example 1 was worn 2.06 mm by erosion upon each immersion of the lance, whereas the lance prepared in Example 1 as worn only 0.62 mm.

The data of Table 2 shows that the lance of Example 1 has a service life 3 times as long as that of the lance of Comparative Example 1.

$$\frac{\text{erosion rate in Comp. Ex. 1 (mm/}ch\text{)}}{\text{erosion rate in Ex. 1 (mm/}ch\text{)}} = 3$$

Various properties of the lances prepared in Example 1 and Comparative Example 1 were checked, and the results are set forth in Tables 3 to 6.

TABLE 3

| | Comp. Ex. 1 | Ex. 1 |
|---|---|---|
| bulk density | 1.9–2.2 t/m$^3$ | 2.2–2.3 t/m$^3$ |
| porosity | 25–30% | 21–23% |
| strength dry | 30–60 kg/cm$^2$ | 65–75 kg/cm$^2$ |

The table demonstrates the high density of the coating formed on the lance according to the method of this invention.

TABLE 4

| Distribution of steel fibers | Comp. Ex. 1 | Ex. 1 |
|---|---|---|
| 0–1 m | 3.0% | 4% |
| 1–2 m | 5.5% | 4% |
| 2–3 m | 2.5% | 4% |
| 3–4 m | 5.0% | 4% |

The table shows that the coating formed on the lance according to the method of this invention had a more uniform distribution of steel fibers than the coating formed on the lance in Comparative Example 1 by casting the coating material in two separate portions.

TABLE 5

| particle size distribution | Comp. Ex. 1 | Ex. 1 |
|---|---|---|
| 0–1 m | fair number of fine particles | uniform |
| 1–2 m | fair number of big particles | uniform |
| 2–3 m | large number of fine particles | uniform |
| 3–4 m | large number of big particles | uniform |

TABLE 6

| | Comp. Ex. 1 | Ex. 1 |
|---|---|---|
| No. of studs | 24 tiers | 3 tiers |

In Comparative Example 1, 24 tiers of studs were arranged around the lance in the vertical direction whereas in Example 1, only 3 tiers of studs were used. In consequence, stainless fibers stuck on the studs in Comparative Example 1, but no such trouble occurred in Example 1.

The following compositions of coating materials for castable refractory material may be desirably used in the present invention:

| Number of Composition | Composition of coating material | | |
|---|---|---|---|
| | $Al_2O_3$ wt % | $SiO_2$ wt % | Clayed binder wt % |
| 1 | 45 | 45 | 10 |
| 2 | 51 | 45 | 4 |
| 3 | 66 | 30 | 4 |

What is claimed is:

1. A method of forming a protective coating on a long lance adapted to be immersed in molten metal, said method comprising the steps of:

providing a long lance having extending therefrom, around the area thereof to be coated, reinforcing members comprising studs, metal gauze or reinforcing bars;

providing an annular mold having in a peripheral portion thereof at least one inlet port having a width greater then the outer diameter of said long lance;

positioning said annular mold on its side so that said inlet port faces upwardly;

positioning said long lance in said annular mold such that there is provided between said mold and said lance a clearance that corresponds to the required thickness of the coating to be formed, with said reinforcing members extending into said clearance;

providing a flowable coating material made of a blend of a castable refractory and of heat-resistant metal fibers and aggregates as reinforcing materials;

casting said flowable coating material through said clearance, while avoiding substantial downward settling of said reinforcing material, and thereby forming on said lance a substantially uniformly dense coating of said coating material; and solidifying and drying said coating.

2. A method as claimed in claim 1, further comprising operating a vibrator during or after said casting of said material, to ensure that said clearance between said lance and said mold is filled with a uniform and dense layer of said coating material.

3. A method as claimed in claim 1, wherein said coating is formed with an excess portion corresponding to said inlet port.

4. A method as claimed in claim 3, further comprising removing said excess portion.

5. A method as claimed in claim 1, wherein said mold is provided with plural said inlet ports spaced longitudinally of said mold, and said coating material is cast through all of said inlet ports.

6. A method as claimed in claim 1, comprising solidifying and drying said coating while still within said mold, and then removing said lance and the thus solidified and dried coating from said mold.

* * * * *